United States Patent [19]

Matyjakowski

[11] Patent Number: 4,557,993

[45] Date of Patent: Dec. 10, 1985

[54] PROCESS FOR PREPARING AN ELECTROPHOTOGRAPHIC IMAGING MEMBER WITH NIO INTERLAYER

[75] Inventor: David J. Matyjakowski, Ontario, N.Y.

[73] Assignee: Xerox Corporation, Stamford, Conn.

[21] Appl. No.: 637,621

[22] Filed: Aug. 3, 1984

[51] Int. Cl.[4] ..... G03G 5/082; G03G 5/14

[52] U.S. Cl. ..... 430/131; 430/65; 427/126.6

[58] Field of Search ..... 430/65, 130, 131; 427/126.6

[56] References Cited

U.S. PATENT DOCUMENTS

| | | | |
|---|---|---|---|
| 2,901,348 | 8/1959 | Dessauer et al. . | |
| 3,816,288 | 6/1974 | Lubicz et al. | 430/65 X |
| 3,844,906 | 10/1974 | Bailey et al. | 204/9 |
| 3,845,739 | 11/1974 | Erhart et al. | 118/49.1 |
| 3,861,353 | 1/1975 | Erhart et al. | 118/49.1 |
| 3,907,650 | 9/1975 | Pinsler | 204/34 |
| 3,911,162 | 10/1975 | Erhart et al. | 427/39 |
| 3,914,126 | 10/1975 | Pinsler . | |
| 4,019,902 | 4/1977 | Leder et al. . | |

FOREIGN PATENT DOCUMENTS

| | | |
|---|---|---|
| 1571850 | 7/1980 | United Kingdom . |

*Primary Examiner*—Roland E. Martin

[57] ABSTRACT

A process for preparing an electrophotographic imaging member comprising providing a nickel substrate, heating the nickel substrate to a temperature of at least 260° C. in the presence of oxygen until a continuous layer of nickel oxide forms on the substrate and depositing at least one photoconductive insulating layer on the continuous layer of nickel oxide.

12 Claims, No Drawings

PROCESS FOR PREPARING AN ELECTROPHOTOGRAPHIC IMAGING MEMBER WITH NIO INTERLAYER

BACKGROUND OF THE INVENTION

This invention relates in general to electrophotography and, more specifically, to a process for preparing an electrophotographic imaging member.

The formation and development of images on the imaging surfaces of electrophotographic imaging members by electrostatic means is well known. One of the most widely used processes being xerography described, for example, in U.S. Pat. No. 2,297,691. Numerous different types of photoreceptors can be used in the electrophotographic imaging process. Such electrophotographic imaging members may include inorganic materials, organic materials, and mixtures thereof. Electrophotographic imaging members may comprise contiguous layers in which one of the layers performs a charge generation function and the other layer forms a charge carrier transport function or may comprise a single layer which performs both the generation and transport functions.

It is customary in the art of electrophotography to form an electrostatic latent image on an electrophotographic imaging member comprising an electrically conductive backing such as, for example, a metallic or metal-coated base having an inorganic photoconductive insulating layer applied thereto in good charge blocking contact. Typical electrophotographic imaging members comprise, for example, an aluminum surface having a thin layer of vitreous selenium with an aluminum oxide and/or polymeric interlayer. Such elements are characterized by being capable of accepting and retaining a suitable uniform electrostatic charge in the dark and of quickly and selectively dissipating a substantial part of the charge when exposed to a light pattern.

As more advanced, higher speed electrophotographic copiers, duplicators, and printers are developed, stringent requirements have been placed on these complex, highly sophisticated systems including long operating life with minimum maintenance requirements. For example, the supporting substrate for electrophotographic imaging members in various configurations such as drums and belts must meet precise tolerance standards and adhere well to photoconductive insulating layers applied thereto. The aluminum drums utilized as supporting substrate material for rigid drum-shaped supporting substrates are relatively expensive; often require replacement due to wear prior to the need to replace the photoconductive insulating layer; are susceptible to wobble due to counterbores that are easily damaged; exhibit narrow coating process latitude; often exhibit poor alloy adhesion characteristics; and often exhibit variable electrical parameters due to the aluminum oxide layer. Moreover, latching and polishing of aluminum drums are necessary prerequisites to achieving a uniform surface for subsequently applied photoconductive insulating layer or layers. Moreover, aluminum drums must necessarily be thick in order to achieve adequate rigidity to meet the stringent tolerence requirements of precision machines. Heavy drums require more powerful drive systems and rugged clutches to overcome high inertia characteristics.

It has been discovered that lightweight electroformed nickel drums and belts may be utilized to address the poor tolerence and inertia characteristics of aluminum substrates. However, coatings of photoconductive insulating layers such as selenium or selenium alloys on nickel surfaces and particularly electroformed nickel substrates, often flake off from the substrate within about a month after application of the coatings. Although synthetic polymer coatings may help minimize flaking, additional coating and drying process steps and as well as coplex equipment are necessary.

The adhesion of photoconductive insulating layers to metal substrates such as nickel may be improved by special chemical treatments. For example, a process is described in U.S. Pat. No. 3,907,650 to Pinsler and in U.S. Pat. No. 3,914,126 to Pinsler in which a nickel substrate is subjected to an acid etching bath followed by an anodizing treatment in an electrolytic bath to obtain at least two intermediate metal oxide layers such as nickel oxide layers. This technique is relatively complex and the resulting surface tends to be somewhat rough. In addition, the Pinsler process requires multiple steps, costly equipment, produces fumes and presents a waste disposal problem.

In U.S. Pat. No. 4,019,902 to L. Leder et al, a nickel substrate is initially bombarded as a cathode, with positive ions of an inert gas of low ionization potential under glow discharge in the presence of oxygen and the resulting oxide-coated substrate is exposed to a vapor cloud of photoconductive material consisting of charged and uncharged material in an electrical field utilizing the metal substrate as a cathode and a donor of the vapor cloud of photoconductive material or container thereof as a anode. After completion of glow discharge treatment sufficient to ion clean the surface, formation of an oxide barrier of about 10–200 Angstroms thickness and heating of the substrate to a temperature of about 55° C.–80° C. (about 5–20 minutes and preferably 8–10 minutes), the heated oxidized substrate (cathode) is simultaneously exposed to a cloud of charged and uncharged photoconductive particles evolved from a heated photoconductor source in and adjacent to a region of glow discharge. This complex process improves the adhesion of photoconductive insulating layers to nickel substrates but the overall photoreceptor life is only about one year due to the eventual formation of NiSe and resulting adhesion loss. Moreover, costly and sophisticated equipment is required to carry out the process.

Thus, there is a continuing need for processes for preparing electrophotographing imaging members having nickel substrates that exhibit improved adhesion to photoconductive insulating layers.

SUMMARY OF THE INVENTION

It is, therefore, an object of the present invention to provide an improved process for preparing an electrophotographic imaging member which overcomes the above-noted disadvantages.

It is yet another object of the present invention to provide an improved process for preparing an electrophotographic imaging member which has longer life.

It is a further object of the present invention to provide a process for preparing an electrophotographic imaging member with improved adhesion between the photoconductive imaging layers and supporting substrates.

It is yet another object of the present invention to provide a process for preparing an electrophotographic imaging member which exhibits improved surface uniformity.

The foregoing objects and others are accomplished in accordance with this invention by providing a process for preparing an electrophotographic imaging member comprising providing a nickel substrate, heating the nickel substrate to a temperature of at least 260° C. in the presence of oxygen until a continuous layer of nickel oxide forms on the substrate and depositing at least one photoconductive insulating layer on the continuous layer of nickel oxide.

The nickel substrate may comprise a substrate made entirely of nickel or comprise a layer on a supporting member. The supporting member may comprise any suitable material including, for example, metals such as titanium, brass, stainless steel and the like or non-metallic heat resistant materials such as polysiloxanes, phenolic resins and the like. The substrate may be flexible or rigid and may have any number of different configurations such as, for example, a plate, a cylindrical drum, a scroll, an endless flexible belt, and the like. The nickel substrate prior to formation of the nickel oxide layer may vary in thickness over substantially wide ranges depending on the desired use of the electrophotoconductive member. Thus, for example, the conductive layer can range in thickness of from about 500 Angstrom units to many centimeters. When a flexible electrophotographic imaging member is desired, the thickness of the conductive layer may be between about 100 micrometers to about 150 micrometers.

Preferably, the nickel substrates consist entirely of nickel and are formed by an electroforming process. Electroformed nickel substrates are light in weight, require very little material, can be formed to meet precise tolerance requirements, are readily reclaimed, cause minimal printout of processing stains, and exhibit tighter electrical parameters. Any suitable electroforming process may be utilized to prepare the nickel substrate. One suitable electroforming process is described in U.S. Pat. No. 3,844,906 to Bailey et al, the disclosure thereof being incorporated herein in its entirety.

If thin electroformed nickel substrates are utilized in the process of this invention, the nickel substrate should contain less than about 0.004 percent by weight sulphur based on the total weight of the nickel layer to avoid imbrittlement of the nickel layer during the elevated temperature oxidation process of this invention. For example, when electroformed nickel substrates formed from nickel raw materials containing about 0.01 percent by weight sulphur based on the total weight of the nickel are employed, the electroformed substrate can shatter during the elevated temperature oxidation step of the process of this invention. A nickel starting raw material containing less than about 0.001 percent by weight sulphur provides excellent low sulphur electroformed layers that do not shatter during the elevated temperature oxidation step of the process of this invention. It is believed that the sulphur migrates to grain boundaries which cause imbrittlement of the nickel layer. If the nickel layer is formed by electroforming on a mandrel, the layer should preferably have a thickness of at least about 102 micrometers to permit removal of the nickel layer from the electroforming mandrel. For drum applications, sufficient rigidity and economy of materials are achieved with electroformed cylinders having a thickness of between about 127 micrometers and about 155 micrometers. Thinner nickel layers may be suitable for flexible belt applications.

Generally, the nickel substrate should be heated to a temperature between about 260° C. and about 650° C. in the presence of oxygen to achieve the improved, void free, continuous nickel oxide layer of this invention. For best results, a heating temperature between about 370° C. and about 480° C. is preferred. The specific temperature selected varies, to some extent upon the time that the nickel substrate is exposed to an elevated temperature and the amount of oxygen present during heating. The time and temperature should be selected to achieve a continuous nickel oxide layer having a thickness of at least about 400 Angstrom units. This minimum thickness of about 400 Angstrom units is marginally acceptable if grown at or about 260° C. because it contains a two-phase mixture of NiO and $Ni_2O_3$ which promotes epaxial growth that tracks along the preferred orientation of the nickel. This epaxial growth increases the tendency of the nickel oxide layer to crack along crystal planes. Thus, the presence of $Ni_2O_3$ should be minimized to enhance stability of the nickel oxide layer. A nickel oxide layer grown above a temperature of about 260° C. and having a thickness of between about 800 Angstroms and about 1200 Angstroms is preferred to ensure achievement of a polycrystalline layer having a random pattern which prevents cracking. For flexible photoreceptors, a nickel oxide layer having a thickness less than about 1,000 Angstrom units is believed to be desirable because of the tendency of thick layers to crack during flexing of the nickel substrate. When the nickel oxide layer has a thickness of between about 800 Angstrom units and about 1200 Angstrom units and is formed at between about 260° C. and about 427° C., it contains a relatively high NiO content of about 90–95 percent by weight based on the total weight of the nickel oxide layer. Although heating of the nickel layer at about 260° C. for about 30 minutes produces a nickel oxide layer containing a relatively high content of $Ni_2O_3$, the nickel oxide layer remains suprisingly stable and forms a satisfactory nickel oxide layer for electrophotographic imaging members. At temperatures less than about 260° C., the oxide coating appears to form a two-phase system. The two-phase oxide coating is normally undesirable because of the expected difficulty in establishing long range control and reproducibility. Excellent results are achieved when the nickel oxide layer is formed by heating the nickel substrate at about 260° C. for about 10–30 minutes or at about 315° C. for about 15 minutes or at about 430° C. for about 10 minutes with oxygen provided by ambient air at atmopheric pressure. It has also been noted that at temperatures greater than about 370° C., a slight degree of surface roughness appears in the oxide layer which further improves adhesion of subsequently deposited electrophotoconductive insulating layers to the nickel oxide layer.

The oxygen present during the formation of the nickel oxide layer may be provided by any suitable source. Typical sources include ambient air, pure oxygen, compressed air, and the like. Ambient air at atmospheric pressure is preferred for reasons of economy, convenience and safety. Since the rate of oxidation is also affected by the amount of oxygen present during heating, less heating time is believed to be required, for example, when the percent of oxygen at atmospheric pressure is increased above about 21 percent or when compressed air is used during heating. Obviously, less reaction time is believed to be required if concentrations of oxygen higher than that found in ambient air are employed.

For purposes of comparison, it is believed that exposure of nickel to normal atmospheric conditions at ambient temperatures causes a NiO layer to form having a thickness of only about 2–10 Angstrom units. This thin NiO layer is evidently not completely continuous and subsequently deposited selenium or selenium alloys react through the nickel oxide layer or holes therein with the underlying nickel layer to form a nickel selenide compound that flakes off within about a month. Also, discontinuous nickel oxide layers should be avoided because the non-uniform electrical properties across the outer surface thereof cause defects in the ultimate xerographic toner images.

Heating of the nickel layer may be effected by any suitable technique. Typical heating processes include oven heating, laser heating, induction heating, and the like and combinations thereof. Oven heating is preferred for reasons of lower cost, higher safety, and lower maintenance requirements. For batch processes, the oven need not be preheated. However, a preheated oven is preferred for continuous processes.

Any suitable photoconductive insulating layer or layers may be applied to the nickel oxide layer of this invention. The photoconductive layers may be organic or inorganic. Typical inorganic photoconductive materials include well known materials such as amorphous selenium, selenium alloys, halogen-doped selenium alloys such as selenium-tellurium, selenium-tellurium-arsenic, selenium-arsenic, and the like. Deposition of selenium and selenium alloy layers onto a supporting substrate is well known in the art and are described, for example, in U.S. Pat. No. 2,803,542; U.S. Pat. No. 2,822,300; U.S. Pat. No. 2,970,906; U.S. Pat. No. 3,312,548; U.S. Pat. No. 3,467,548; and U.S. Pat. No. 3,655,377, the disclosures of these patents being incorporated by reference herein in their entirety.

If desired, the photoconductive insulating layer may comprise inorganic or organic photoconductive particles dispersed in an electrically insulating binder. Typical inorganic compounds include cadmium sulfoselenide, cadmium selenide, cadmium sulfide and mixtures thereof, typical inorganic photoconductive glasses include amorphous selenium and selenium alloys such as selenium-tellurium, selenium-tellurium-arsenic and selenium-arsenic and mixtures thereof. Binder plates of this type are well known in the art and are described, for example in U.S. Pat. No. 3,121,006, the disclosure of this patent being incorporated by reference herein in its entirety.

Any suitable multilayer photoconductors may also be employed with the nickel substrate of this invention. The multilayer photoconductors comprise at least two electrically operative layers, a photogenerating or charge generating layer and a charge transport layer. Examples of photogenerating layers include trigonal selenium, various phthalocyanine pigments such as the X-form of metal free phthalocyanine described in U.S. Pat. No. 3,357,989, metal phthalocyanines such as copper phthalocyanine, quinacridones available from DuPont under the tradename Monastral Red, Monastral violet and Monastral Red Y, substituted 2,4-diaminotriazines disclossed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange. Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and copending application entitled "Layered Photoresponsive Imaging Devices," U.S. Ser. No. 466,764, filed in the names of Leon A. Teuscher, Frank Y. Pan and Ian D. Morrison on Feb. 15, 1983; dyestuff generator layer and oxadiazole, pyrazalone, imidazole, bromopyrene, nitrofluourene and nitronaphthalimide derivative containing charge transport layers members disclosed in U.S. Pat. No. 3,895,944; generator layer and hydrazone containing charge transport layers members disclosed in U.S. Pat. No. 4,150,987; generator layer and a tri-aryl pyrazoline compound containing charge transport layer members disclosed in U.S. Pat. No. 3,837,851; and the like. The disclosures of these patents and application are incorporated herein in their entirety.

Generally, the photoconductive insulating layer or layers applied to the nickel oxide layer should be applied under conditions in which the temperature of the nickel oxide layer is maintained above about 38° C. This enhances adhesion of selenium alloy to the nickel oxide layer.

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

EXAMPLE I

An electroformed cylinder of nickel having a diameter of about 8.4 centimeters and a thickness of about 127 micrometers was cleaned by rinsing in deionized water for about 2 minutes. The cylinder was formed by the electroforming process described in U.S. Pat. No. 3,844,906, the disclosure thereof being incorporated herein in its entirety. The electroformed nickel cylinder had a sulphur content of less than about 0.004 percent by weight based on the weight of the entire cylinder. This cylinder was coated in a planetary vacuum coater device having a configuration described in U.S. Pat. No. 3,845,739, the disclosure thereof being incorporated herein in its entirety. The cylinder was mounted on a rotatable mandrel for preheating by means of glow discharge bars. The glow discharge bars included an electrode comprising an elongated, electrically conductive glow bar member which was positioned adjacent the annular path of travel of the rotating mandrel. The glow discharge bars were spaced a radial distance from the mandrels by adjustable spacing means for providing the desired discharge. The cylinder was rotated and also transported in an annular path past the glow discharge bars. Boats of a crucible array containing a charge of a photoconductive selenium alloy consisting of about 99.5 percent by weight selenium, about 0.5 percent by weight arsenic and about 30 parts per million chlorine were placed within the annular path of travel of the cylinder. Electric motors were energized to rotate the mandrel on which the cylinder was supported and to maintain a planetary motion of the cylinder within a bell-shaped vacuum chamber housing. A vacuum pumping operation connected to the vacuum chamber housing was initiated by activating a vacuum pumping means. A plate supporting the horizontally rotatable mandrel in the bell-shaped vacuum chamber housing was rotated at a rate of about 5 rpm and the mandrel was rotated at a rate of about 15 rpm. Pump down of the chamber proceeded until the chamber pressure reached a value on the order of about 10–50 milli-Torr. This chamber pressure was maintained by a pressure sensing transducer which operated in conjunction with the vacuum pumping means. Air conveyed through a moisture removing device was admitted to the chamber by a control leak during this period of time. With the chamber pressure maintained within the about 10–50 milli-Torr, the glow discharge process was initiated. A voltage of between about 1,000 and 5,000 volts was applied to electrode elements which established a high voltage plasma between the glow bar cathodes and the cylinder anodes. This plasma discharge preheated the cylinder prior to initiation of the vapor deposition of the selenium alloy material on the cylinders. The plasma discharge was continued and cylinder temperature on the order of about 40° C. to about 75° C. was attained. The control leak was shut off and pump down was again initiated in order to reduce the pressure within the chamber to a pressure on the order of about $5\times10^{-4}$ Torr or less. Electrical power was then applied to the crucible array for heating the crucibles and causing vaporization of the selenium alloy photoconductive material contained therein. A closed loop temperature control means was used to control the temperature of the crucible in a programmed manner until the desired alloy thickness was established. The cylinder temperature exhibited an increase in temperature of about 10° C. to 50° C. during the application of electrical power to the crucible assembly. At this time power to the crucible was interrupted and a cooling dwell time was provided. The vacuum chamber was then returned to atmospheric conditions. The initial vacuum operation was performed in about 12 minutes; the glow discharge was preformed in about 2 to 20 minutes; the further reduction in vacuum within the chamber occured in about 1 minute; the power was applied to the crucible for about 25 to 60 minutes; the temperature cooling dwell time was about 5 minutes and the pressurization to atmospheric pressure occupied approximately 5 minutes. After 30 days following coating, the deposited selenium alloy layer was removed in the form of flakes from the cylinder by severely flexing the cylinder. The rear surface of the removed photoconductive layer was examined using an ion mass micro analyzer (IMMA). It was found that the nickel oxide formed on the nickel cylinder was relatively thick but located only in numerous spots or islands heterogeneously scattered about the surface of the cylinder. These islands ranged in size from about 30 micrometers to about 100 micrometers. Spots observed on the rear surface of the photoconductive layer contained a high concentration of nickel and are believed to be nickel selenide indicating that the deposit of selenium reacted with the underlying nickel layer through various segments of the nickel oxide layer. This test indicates that glow discharge alone was not suitable for providing a uniform, void free, continuous barrier of nickel oxide needed for extended photoreceptor life.

EXAMPLE II

The procedure described in Example I was repeated with an electroformed nickel cylinder identical to that described in Example I except that after cleaning by rinsing in deionized water for about 2 minutes and prior to mounting the cylinder on the rotatable mandrel, the cylinder was heated in ambient air in an oven maintained at 260° C. for 24 hours, cooled and thereafter mounted on the rotatable mandrel. After 30 days following coating, the deposited selenium alloy layer was removed in the form of flakes from the cylinder by severely flexing the cylinder. The rear surface of the removed photoconductive layer was examined using an ion mass micro analyzer. It was found that the nickel oxide formed on the nickel cylinder and removed with the photoconductive layer was a thick, uniform, void free, and continuous barrier of nickel oxide which prevented the deposit of selenium from reacting with the underlying nickel layer. This test indicates that the high temperature nickel oxide layer forming treatment of this invention provided a uniform, void free, continuous barrier of nickel oxide needed for extended photoreceptor life.

EXAMPLE III

The procedure described in Example II was repeated except that the cylinder was heated in ambient air in an oven maintained at 260° C. for 30 minutes instead of 24 hours. After 48 hours following coating, the deposited selenium alloy layer was removed in the form of flakes from the cylinder by severely flexing the cylinder. Examination of the rear surface of the removed photoconductive layer using secondary ion mass spectroscopy (SIMS) and an electron microprobe mass analyzer (EMPA) revealed that the uniform and continuous nickel oxide coating formed prevented the formation of NiSe. Also, no spots high in nickel were found during examination using an ion mass micro analyzer (IMMA) compared to the glow discharge treated sample of Example I. To ensure that spots were not being masked by surface morphological effects, 25 random units (5,000 micrometers$^2$ each) were profiled for Ni and Se. In no case was NiSe containing spots observed at a significant level. Re-examination after about 18 months revealed that the cylindrical substrates of this Example were still free of NiSe whereas numerous spots of NiSe were observed on the back surface of electrophotographic imaging members prepared by the process of Example I. This test indicates that the high temperature nickel oxide layer forming treatment of this invention provided a uniform, void free, continuous barrier of nickel oxide needed for extended photoreceptor life.

EXAMPLE IV

The procedures of Example II were repeated with oxide formation being conducted in ambient air in an oven maintained at 427° C. for about 3 minutes to form a nickel oxide layer having a thickness of about 1,000–1200 Angstrom units on the cylinder. After 48 hours following coating, the deposited selenium alloy layer was removed in the form of flakes from the cylinder by severely flexing the cylinder. Examination of the rear surface of the removed photoconductive layer using secondary ion mass spectroscopy (SIMS) and an electron microprobe mass analyzer (EMPA) revealed that the uniform and continuous nickel oxide coating formed prevented the formation of NiSe. Also, no spots high in nickel were found during examination using an ion mass micro analyzer (IMMA) compared to the glow discharge treated sample of Example I. To ensure that spots were not being masked by surface morphological effects, 25 random units (5,000 micrometers$^2$ each) were profiled for Ni and Se. In no case was NiSe containing spots observed at a significant level. Re-examination after about 18 months revealed that the cylindrical substrates of this Example were still free of NiSe whereas numerous spots of NiSe were observed on the back surface of electrophotographic imaging members prepared by the process of Example I. Moreover, the photoconductive layer exhibited better adhesion to the nickel oxide layer and no flaking was observed 18 months after coating with the selenium alloy. In addition, it was extremely difficult to remove the photoconductive layer from the cylinder by scraping with a stainless steel scalpel. This test indicates that the high temperature nickel oxide layer forming treatment of this invention provided a uniform, void free, continuous barrier of nickel oxide needed for extended photoreceptor life.

EXAMPLE V

The procedures of Example IV were repeated with oxide formation being conducted in ambient air in an oven maintained at 427° C. for about 5 minutes. The thickness and other characteristics of the oxide layer were substantially the same as that in Example III.

EXAMPLE VI

The process of Example IV was repeated except that the oxide layer was formed in an oven maintained at about 427° C. for 10 minutes. The oxide thickness was substantially the same as that in Example III.

EXAMPLE VII

The process of Example IV was repeated except that the oxide layer was formed in an oven maintained at about 427° C. for 15 minutes. The oxide thickness was substantially the same as that in Example III.

EXAMPLE VIII

The process of Example IV was repeated except that the oxide layer was formed in an oven maintained at about 427° C. for 20 minutes. The oxide thickness had a thickness greater than about 1,200 Angstrom units and was thicker than the oxide layers in Examples IV–VIII.

EXAMPLE IX

An electroformed cylinder of nickel having a diameter of about 8.4 centimeters and a thickness of about 127 micrometers was cleaned by rinsing in deionized water for about 2 minutes. The cylinder was formed by the electroforming process described in U.S. Pat. No. 3,844,906, the disclosure thereof being incorporated herein in its entirety. The electroformed nickel cylinder had a sulphur content of less than about 0.004 percent by weight based on the weight of the entire cylinder. The cylinder was heated in ambient air in an oven maintained at 416° C. for 12 minutes and cooled to room temperature. This cylinder was then coated in a planetary vacuum coater device having a configuration described in U.S. Pat. No. 3,845,739, the disclosure thereof being incorporated herein in its entirety. The cylinder was mounted on a rotatable mandrel for preheating by means of glow discharge bars. The glow discharge bars included an electrode comprising an elongated, electrically conductive glow bar member which was positioned adjacent the annular path of travel of the rotating mandrel. The glow discharge bars were spaced a radial distance from the mandrels by adjustable spacing means for providing the desired discharge. The cylinder was rotated and also transported in an annular path past the glow discharge bars. Boats of a crucible array containing a charge of a photoconductive selenium alloy consisting of about 99.5 percent by weight selenium, about 0.5 percent by weight arsenic and about 30 parts per million chlorine were placed within the annular path of travel of the cylinder. Electric motors were energized to rotate the mandrel on which the cylinder was supported and to maintain a planetary motion of the cylinder within a bell-shaped vacuum chamber housing. A vacuum pumping operation connected to the vacuum chamber housing was initiated by activating a vacuum pumping means. A plate supporting the horizontally rotatable mandrel in the bell-shaped vacuum chamber housing was rotated at a rate of about 5 rpm and the mandrel was rotated at a rate of about 15 rpm. Pump down of the chamber proceeded until the chamber pressure reached a value on the order of about 10–50 milli-Torr. This chamber pressure was maintained by a pressure sensing transducer which operated in conjunction with the vacuum pumping means. Air conveyed through a moisture removing device was admitted to the chamber by a control leak during this period of time. With the chamber pressure maintained within the about 10–50 milli-Torr, the glow discharge process was initiated. A voltage of between about 1,000 and 5,000 volts was applied to electrode elements which established a high voltage plasma between the glow bar cathodes and the cylinder anodes. This plasma discharge preheated the cylinder prior to initiation of the vapor deposition of the selenium alloy material on the cylinders. The plasma discharge was continued and cylinder temperature on the order of about 40° C. to about 75° C. was attained. The control leak was shut off and pump down was again initiated in order to reduce the pressure within the chamber to a pressure on the order of about $5\times10^{-4}$ Torr or less. Electrical power was then applied to the crucible array for heating the crucibles and causing vaporization of the selenium alloy photoconductive material contained therein. A closed loop temperature control means was used to control the temperature of the crucible in a programmed manner until the desired alloy thickness was established. The cylinder temperature exhibited an increase in temperature of about 10° C. to 50° C. during the application of electrical power to the crucible assembly. At this time power to the crucible was interrupted and a cooling dwell time was provided. The vacuum chamber was then returned to atmospheric conditions. The initial vacuum operation was performed in about 12 minutes; the glow discharge was performed in about 2 to 20 minutes; the further reduction in vacuum within the chamber occured in about 1 minute; the power was applied to the crucible for about 25 to 60 minutes; the temperature cooling dwell time was about 5 minutes and the pressurization to atmospheric pressure occupied approximately 5 minutes. After 30 days following coating, the deposited selenium alloy layer was removed in the form of flakes from the cylinder by severely flexing the cylinder. After 48 hours following coating, the deposited selenium alloy layer was removed in the form of flakes from the cylinder by severely flexing the cylinder. Examination of the rear surface of the removed photoconductive layer using secondary ion mass spectroscopy (SIMS) and an electron microprobe mass analyzer (EMPA) revealed that the uniform and continuous nickel oxide coating formed prevented the formation of NiSe. Also, no spots high in nickel were found during examination using an ion mass micro analyzer (IMMA) compared to the glow discharge treated sample of Example I. To ensure that spots were not being masked by surface morphological effects, 25 random units (5,000 micrometers$^2$ each) were profiled for Ni and Se. In no case was NiSe containing spots observed at a significant level. Re-examination after about year revealed that the cylindrical substrate of this Example were still free of NiSe whereas numerous spots of NiSe were observed on the back surface of electrophotographic imaging members prepared by the process of Example I. This test indicates that the high temperature nickel oxide layer forming treatment of this invention provided a uniform, void free, continuous barrier of nickel oxide needed for extended photoreceptor life.

EXAMPLE X

The procedures of Example IX were repeated with oxide formation being conducted in ambient air in an oven maintained at 310° C. for about 5 minutes. The thickness of the nickel oxide layer was about 500–600 Angstrom units. The other characteristics of the oxide layer were substantially the same as that of the oxide layer in Example IX.

EXAMPLE XI

The procedures of Example IX were repeated with oxide formation being conducted in ambient air in an oven maintained at 316° C. for about 5 minutes. The thickness and other characteristics of the oxide layer were substantially the same as that in Example IX.

EXAMPLE XII

The procedures of Example IX were repeated with oxide formation being conducted in ambient air in an oven maintained at 316° C. for about 15 minutes. The thickness and other characteristics of the oxide layer were substantially the same as that in Example IX.

EXAMPLE XIII

The procedures of Example IX were repeated with oxide formation being conducted in ambient air in an oven maintained at 316° C. for about 2 minutes. The thickness and other characteristics of the oxide layer were substantially the same as that in Example IX.

Although the invention has been described with reference to specific preferred embodiments, it is not intended to be limited thereto, rather those skilled in the art will recognize that variations and modifications may be made therein which are within the spirit of the invention and within the scope of the claims.

I claim:

1. A process for preparing an electrophotographic imaging member comprising providing a nickel substrate resistant to shattering at temperatures of at least about 260° C., heating said nickel substrate to a temperature of at least about 260° C. in the presence of oxygen until a continuous layer of nickel oxide having a thickness of at least about 400 Angstrom units forms on said substrate and depositing at least one photoconductive layer selected from the group consisting of amorphous selenium, selenium alloys and mixtures thereof on said nickel oxide layer.

2. A process for preparing an electrophotographic imaging member according to claim 1 including heating said nickel substrate to a temperature of at least about 260° C. in the presence of oxygen for at least about 2 minutes.

3. A process for preparing an electrophotographic imaging member according to claim 1 including heating said nickel substrate to a temperature of at least about 260° C. in the presence of oxygen until said continuous layer of nickel oxide has a thickness of between about 800 Angstrom units and about 1200 Angstrom units.

4. A process for preparing an electrophotographic imaging member according to claim 1 including heating said nickel substrate to a temperature between about 260° C. and about 650° C. in the presence of oxygen.

5. A process for preparing an electrophotographic imaging member according to claim 1 wherein said nickel substrate contains less than about 0.004 percent by weight sulphur based on the total weight of the nickel.

6. A process for preparing an electrophotographic imaging member according to claim 1 wherein said nickel substrate is an electroformed cylinder having a thickness of between about 127 micrometers and about 155 micrometers.

7. A process for preparing an electrophotographic imaging member according to claim 1 including heating said nickel substrate to a temperature of between about 370° C. and about 480° C.

8. A process for preparing an electrophotographic imaging member according to claim 1 including heating said nickel substrate to a temperature of at least about 260° C. in the presence of oxygen until said continuous layer of nickel oxide has a thickness of between 800 Angstrom units and about 1200 Angstrom units.

9. A process for preparing an electrophotographic imaging member according to claim 1 wherein said photoconductive insulating layer is selected from the group consisting of amorphous selenium, selenium selenium-tellurium alloys, selenium-tellurium-arsenic alloys, selenium-arsenic alloys and mixtures thereof.

10. A process for preparing an electrophotographic imaging member according to claim 1 wherein said photoconductive insulating layer is deposited at a temperature of at least about 38° C.

11. A process for preparing an electrophotographic imaging member according to claim 8 wherein said continuous layer of nickel oxide is uniform and free of voids.

12. A process for preparing an electrophotographic imaging member comprising providing an electroformed nickel substrate containing less than about 0.004 percent by weight sulphur based on the total weight of the nickel, heating said nickel substrate to a temperature of at least about 260° C. in the presence of oxygen until a continuous layer of nickel oxide having a thickness of at least about 400 Angstrom units forms on said substrate and depositing at least one photoconductive layer selected from the group consisting of amorphous selenium, selenium alloys and mixtures thereof on said nickel oxide layer.

* * * * *